US005934835A

United States Patent [19]

Whitty, Jr. et al.

[11] Patent Number: 5,934,835

[45] Date of Patent: Aug. 10, 1999

[54] PRESTRESSING CONCRETE FOUNDATION PILE HAVING A SINGLE PRESTRESSING STRAND

[76] Inventors: Stephen K. Whitty, Jr., 58101 Jefferson Ave; Henry R. Whitty, 34483 Hwy. 433, both of Slidell, La. 70460

[21] Appl. No.: 08/778,034

[22] Filed: Jan. 2, 1997

Related U.S. Application Data

[63] Continuation-in-part of application No. 08/514,747, Aug. 14, 1995, which is a continuation-in-part of application No. 08/236,476, May 3, 1994, abandoned.

[51] Int. Cl.[6] ..... E02D 5/30

[52] U.S. Cl. ..... 405/232; 405/252; 405/255; 405/256

[58] Field of Search ..... 405/231, 232, 405/251, 252, 255, 256; 173/210; 52/223.4, 223.5, 223.8, 223.13, 223.14, 299, 295, 274, 283

[56] References Cited

U.S. PATENT DOCUMENTS

| | | | |
|---|---|---|---|
| 975,514 | 11/1910 | Cummings | 405/256 |
| 1,954,070 | 4/1934 | Cook | 405/251 |
| 2,355,190 | 8/1944 | Upson | 405/256 X |
| 3,211,241 | 10/1965 | Kikuchi | 405/255 X |
| 3,248,888 | 5/1966 | Williams | 52/233.4 X |
| 3,382,680 | 5/1968 | Takano | 405/256 X |
| 3,501,920 | 3/1970 | Uchiyama | 405/256 |
| 3,651,653 | 3/1972 | Mouton, Jr. | 405/252 |
| 4,009,550 | 3/1977 | Young | 405/256 X |
| 4,127,002 | 11/1978 | DeWitt | 405/252 X |
| 4,239,419 | 12/1980 | Gillen, Jr. | 405/256 X |
| 4,307,550 | 12/1981 | Behar | 52/223.13 |
| 4,327,703 | 5/1982 | Destree | 405/256 X |
| 4,366,870 | 1/1983 | Frederick | 173/210 X |
| 4,604,003 | 8/1986 | Francoeur et al. | 405/256 |
| 4,627,769 | 12/1986 | Lee | 405/256 |
| 4,735,527 | 4/1988 | Bullivant | 405/252 X |

FOREIGN PATENT DOCUMENTS

| | | | |
|---|---|---|---|
| 706490 | 12/1979 | U.S.S.R. | 405/252 |
| 1158690 | 5/1985 | U.S.S.R. | 405/255 |
| 1173003 | 8/1985 | U.S.S.R. | 405/255 |
| 26091 | 1/1908 | United Kingdom | 405/256 |
| 1162378 | 8/1969 | United Kingdom | 405/252 |

*Primary Examiner*—Tamara Graysay
*Assistant Examiner*—Frederick L. Lagman
*Attorney, Agent, or Firm*—Michael D. Carbo; Jacqueline M. Daspit

[57] ABSTRACT

A solid pre-cast prestressed concrete foundation pile and associated installation components having a single prestressing strand located on the longitudinal center axis of the pile, reinforced in the ends only with helix shaped wire reinforcement. The prestressing strand extends beyond the concrete face on the end to present an attachment point for a connection device used to transmit forces from a structure foundation and to accommodate the utilization of a unique, reusable cushion block and, where necessary a, particular internal splice device to form a continuous pile composed of multiple segments.

The cushion block receives hammer blows applied to the top of the pile necessary to the driving (installation) process, affording protection to the pile top, the exposed strand and the internal splice device. The completed installation may include the optional attachment of the connection device (when required) after removal of the cushion block.

4 Claims, 3 Drawing Sheets

PRESTRESSING CONCRETE FOUNDATION PILE HAVING A SINGLE PRESTRESSING STRAND

CROSS-REFERENCE TO RELATED APPLICATION

This application is a continuation in part of application Ser. No. 08/514,747, pending, filed on Aug. 14, 1995, which in turn is a continuation in part of application Ser. No. 08/236,476, abandoned after Aug. 14, 1995, filed on May 3, 1994. Applicants desire priority under 35 U.S.C. Section 120 based upon application Ser. No. 08/514,747, currently pending, and upon application Ser. No. 08/236,476, abandoned.

BACKGROUND OF THE INVENTION

1. Field of the Invention

This invention relates to a solid pre-cast prestressed concrete foundation pile which is prestressed during manufacture by means of a single, central longitudinal prestressing strand (cable).

2. Description of Related Art

The effects of prestressing concrete members with steel strands has been long recognized as a means of providing additional bending strength necessary for the pre-casting of long slender units which require this added strength when being removed from the casting molds, when being handled in transport, and, in the case of foundation piles, preparatory to driving and during the driving process. It is recognized that concrete without reinforcement imparts very little resistance to tensile forces. Tensile forces occurring during driving must be accommodated and, although not a requirement in all pile applications, tension capacity in installed piles is frequently desired, in which case provision for connection to the other foundation structural elements must be made. Reinforcing and prestressing provide a means of developing the desired strength in bending and tension in pre-cast concrete piles.

Over time, several methods have been used to impart this additional strength through reinforcing. Historically, pre-cast prestressed piles have used a plurality of "prestressing strands" where each strand is composed of several high strength wires twisted together mechanically forming a single cable-like strand. These multiple strands are typically arranged in a uniform, symmetrical pattern near the edges of the pile's surface. This is usually combined with conventional reinforcing consisting of deformed steel rods and wire spiral, customarily for the full length of the pile or pile segment.

Several reinforcing methods have also been patented, however these relate to different configurations of reinforcing and/or to different pile types from the present invention which employs only one prestressing strand and employs wire spiral reinforcing in the ends only.

In U.S. Pat. No. 4,627,769 (Lee), a concrete foundation pile with a central removable threaded bar is demonstrated which requires anchorage plates and a steel capping plate, and incorporates a hollow sheath to permit the removal of the reinforcing bar for re-use with other piles.

U.S. Pat. No. 4,735,527 (Bullivant) relates to cylindrical pre-cast pile sections joined to form a continuous load-bearing pile with the sections approximately one meter in length and having at least one longitudinal rod with included spigot on one end and a socket on the other, the purpose of which is not only to reinforce the length of pile, but also to afford a means of mechanically attaching short segments to form a long complete pile.

U.S. Pat. No. 3,501,920 (Uchiyama) offers tubular concrete poles, piles or the like products having a plurality of non-tensioned ordinary-strength wires used in combination with conventional pretensioned high-strength steel wires all arranged at equal intervals in a common circle with auxiliary reinforcement wound spirally and from end to end around the axial reinforcement. The centrifugal compaction technique of fabrication is the suggested method of casting for this invention.

Common to all types of pre-cast concrete piles, whether pre-cast conventionally or prestressed, load-bearing foundation piles or concrete sheet piles as used in retaining walls, cushioning elements must be employed on the top of the piles when impact driving methods are used for the installation of the piles. Typically a block of wood or some other material is introduced between the pile top and the hammer accessory or base, usually by wedging or fixing the cushion material into the underside of the hammer or hammer accessory prior to placing the hammer on the pile. This method of cushioning has been employed in the United States for more than forty-five years and routinely presents a safety hazard to those installing the piles in that they must position themselves, or parts of their body, directly under the suspended piledriving hammer in order to install the cushion block in the hammer drive cap accessory or base.

In the case of U.S. Pat. No. 3,211,241 (Kikuchi) a metal protective or cap device is demonstrated, for use during driving, which covers the top of a rectangular pile as used in a retaining wall during driving and which device is bolted or fixed to the top of the pile and includes an open recess for the purpose of containing an impact receiving block.

SUMMARY OF THE INVENTION

The present invention provides a solid pre-cast prestressed concrete foundation pile, preferably approximately square in cross sectional shape, with beveled edges and having a single prestressing strand placed on the neutral longitudinal axis of the pile. As opposed to prior methods of fabrication where a constant diameter helically wound (spiral) wire situated within the body of the pile extends for the full length of the pile, the present invention locates the helically or spirally wound wire only in the end portions of the pile when fabricated. This helically wound wire provides a hoop effect, reinforcing and protecting the end portions against impact damage during driving. A purpose of this invention is to take advantage of technological advances in materials to provide a concept and design able to offer an economical, full length, environmentally safe, alternative product to currently available pile materials (e.g. timber piles treated with toxic preservatives) suitable for relatively light load requirements. Utilizing the present invention, piles approximately 125 mm to 200 mm square and with lengths in excess of 18 meters can provide per pile capacities on the order of 25 to more than 50 tons each.

Additionally an optional internal sleeve splice, preferably square, is provided whereby the pile may be extended beyond the practical lengths of manufacture or may be produced in shorter interconnecting segments for use where longer continuous lengths are not feasible due to either equipment or site limitations. By locating a single continuous strand on the center axis of the pile, the effective prestressing forces are balanced throughout the pile. The strand extends beyond the end faces of the pile some appropriate short distance (approximately 150 mm to 250 mm or approximately 110% to 115% of the side dimension of the pile). of course, to facilitate driving, the bottom face of a first driven pile, or pile segment in the case of multiple pile segment piles, preferably has the strand cut flush with the bottom end face. The pile is otherwise manufactured using typical strength concrete as is normally used in pre-cast prestressed piles and with tension being applied to the prestressing strand prior to the placement of the concrete.

The implementation of the cushion block during driving protects the end surface from impact and tensile stress damage when being struck by the hammer. The design also permits safe, easy attachment of the cushion block to the pile end prior to hoisting under the hammer, protects the pile end from bumping while being hoisted under the hammer, protects the exposed portion of strand and, because of the countersink, affords protection to the embedded portion of the internal sleeve splice when used.

The exposed portion of strand maintains the cushion block in its desired centered position, serves as a centering device to maintain the concentric axial alignment of the pile under the piledriving hammer, provides a means for the attaching of tension connection devices as may be required during use of the installed pile and, when conditions demand, as an integral element of an internal sleeve splice device.

It is intended that this pile be installed by conventional means of piledriving utilizing an impact (blow) inducing pile hammer. This is accomplished by use of the pile-hammer adaptor which accommodates the relatively small cross-sectional shape of the pile to the typically larger hammer drive cap assembly and further, in combination with the exposed strand, assures critical axial alignment of the pile and hammer during driving.

BRIEF DESCRIPTION OF THE DRAWINGS

An example of the invention is described with reference to the accompanying drawing where.

DETAILED DESCRIPTION OF THE INVENTION

Figure 1:
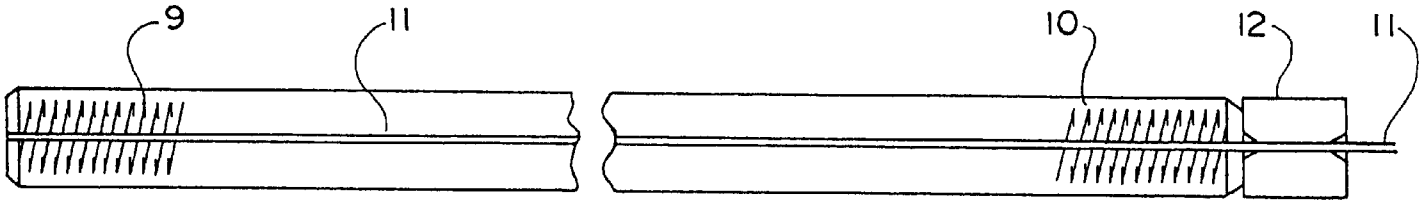
FIG. 1 is a transverse longitudinal section through the length of a prestressed pre-cast concrete pile with a cushion block in place.
Figure 3:
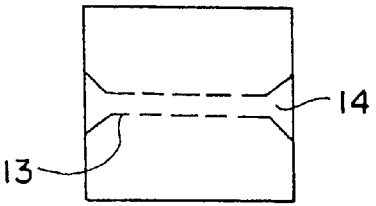
FIG. 3 is a lateral view of an embodiment of a cushion block.

The pile illustrated in FIG. 1 is cast in one section to the length required. The left hand section of the pile depicted in FIG. 1 represents the lower portion of the pile, that which is driven into the ground first and which will be the lowest end of the installed pile. The helix reinforcement 9 is provided in a length of approximately ½ to ⅔ meters to protect this end of the pile when obstructions or dense strata are encountered as driving occurs and is preferably composed of a single approximately 0.225 inch diameter wire turned in a helical (spiral) shape of uniform diameter. The diameter of the turns of wire forming the helix or spiral is to such dimension and placement that there are adequate amounts of concrete covering on all sides as well on the end portions of the pile.

The right hand section of the pile depicted in FIG. 1 represents the top of the pile, that end which is struck by the hammer during driving. The helix or spiral reinforcement 10 is provided to protect the pile as in 9 above and is of identical construction and placement. This reinforcement further strengthens the pile against damage due to the sharp impulse energy transfer which occurs with each hammer blow. The stressing strand 11 is continuous throughout the length of the pile and extends beyond the top end to some required distance predetermined by the anticipated cushion block thickness. During manufacture this strand 11 and reinforcing wire helix or spiral 9 and 10 are properly placed in the mold. The strand 11 is tensioned prior to pouring the concrete which forms the pile. After initial curing of the concrete, the tension previously applied to the stressing strand 11 is released. Upon release and because of the bond between the concrete and the strand 11, the tensile forces of the strand 11 are transferred to the concrete in the pile as compressive forces, imparting additional strength needed for removal of the cast pile from the mold, for transport and handling to and at the site and, for sustaining the rigors of driving.

Figure 4:
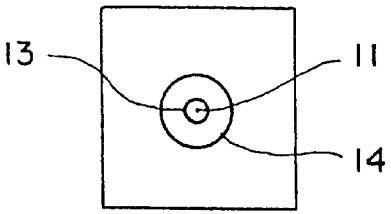
FIG. 4 is a plan view of the block shown in FIG. 3.
Figure 2:
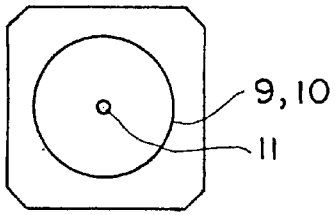
FIG. 2 is a plan view of the pile depicted in FIG. 1.
Figure 12:
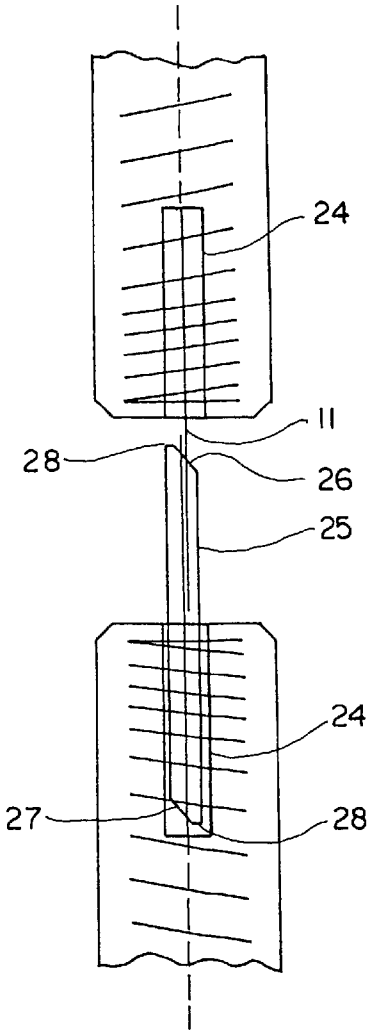
FIG. 12 is a lateral view of a sleeve splice showing as an element of the splice.
Figure 10:
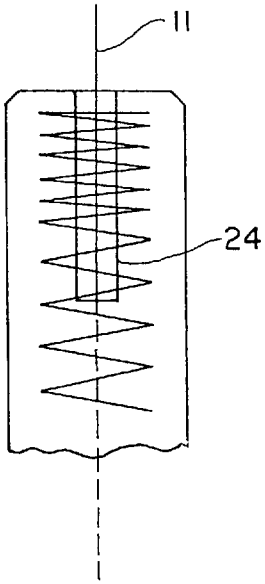
FIG. 10 is a lateral view of an embodiment of a sleeve splice used to extend the length of a pile or to join segments of pile together.
Figure 11:
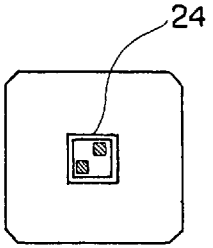
FIG. 11 is an end view of an embodiment of a sleeve splice.

The cushion block 12, as shown in FIG. 4, is manufactured from a single block of wood, laminated layers of plywood, laminated layers of phenolic impregnated canvas, or a polymer material. The material used and the thickness of the block for a particular application is determined by anticipated driving resistances of the soil and the strength of the concrete used in casting the prestressed pile. The cushion block is fabricated such that the grain of the wood, the laminated layers of plywood or layers of phenolic impregnated canvas are preferably situated parallel to the end face of the pile and perpendicular to the longitudinal axis of the pile. When fabricated from polymer materials the cushion block is cast and/or machined to the appropriate configuration. The cushion block 12 may be banded with steel bands to further increase durability. Regardless of the material used, the cushion block 12 preferably has the same or larger cross section size as the pile. In FIG. 4, a hole 13, slightly larger than the strand 11, is provided for the full thickness of the block and has a countersink 14 on each end. The cushion block is centered on the end of the pile and maintained in position by the extended portion of the exposed strand threaded through the center hole 13 and situated with the sides parallel to the sides of the pile. The extended portion of strand 11 continues through the hole 13 and beyond when the cushion block is placed at the end of the pile. The countersink 14 is provided to both ends of the block to facilitate safe installation of the block in the field and to provide clearance for the embedded portion of an internal sleeve splice, as shown in FIGS. 10, 11 and 12, when used.

Figure 9:
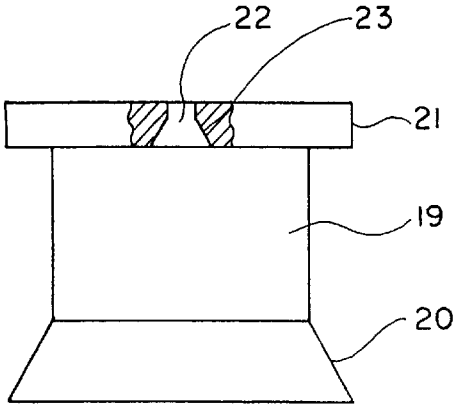
FIG. 9 is a lateral view of the pile-hammer adaptor used to adapt the end of a pile to the hammer drive cap and to maintain the pile and hammer in concentric axial alignment during driving.

The end of the strand 11 projecting beyond the end of the block is provided to center the pile under the hammer when upright preparatory to and during driving. It maintains the pile position relative to the hammer's axial alignment and is protected during driving by use of cushion block 12 and the pile-hammer adaptor as depicted in FIG. 9. After driving, the cushion block 12 is removed for reuse on subsequently driven piles. The portion of strand 11 protruding beyond the end of the pile after removal of the cushion block 12 provides a place of anchorage for the attachment of the tension connection device shown in FIG. 5 when required for the transmission of tension load (uplift) capacity to the installed pile.

Figure 6:
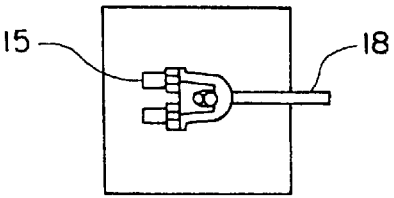
FIG. 6 is a plan view of the tension connection device attached to the pile as in FIG. 5.
Figure 7:
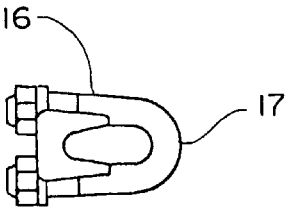
FIG. 7 is the tension connection clamp used in the tension connection device.
Figure 8:
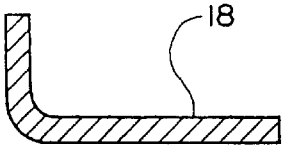
FIG. 8 is the deformed rod used in the tension connection device.
Figure 5:
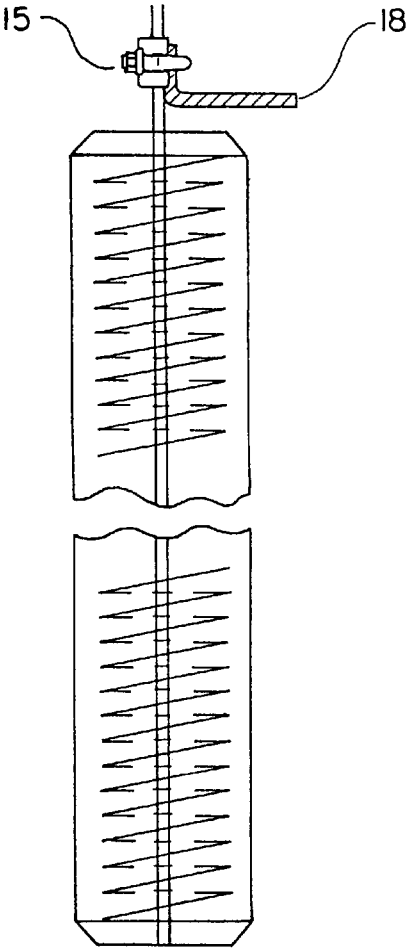
FIG. 5 is a lateral view of the tension connection device attached to the pile in an upright position.

The tension connection device as shown in FIG. 5 is a means of transmitting tensile loads from other foundation elements (i.e. footings, caps, grade beams, sills, etc.) to the pile. Multiple installations of the device may be made to the same exposed portion of strand on a single pile for added tension capacity. This tension connection device as shown in FIGS. 5 and 6 is comprised of a clamp 15 which attaches a deformed reinforcing bar 18 to the exposed strand. The clamp 15, further shown isolated in FIG. 7 consists of a "U" bolt 16 with two nuts and a saddle 17 which has lugs matching the twist pattern of the prestressing strand 11 affording increased resistance to sliding or movement when under load conditions. The deformed bar 18 is fabricated in an "L" shape as shown in FIG. 8 and is made from normal high strength reinforcing steel.

The pile-hammer adaptor as shown in FIG. 9 is fabricated of steel or other suitable material and is provided to accommodate the relatively small cross-sectional shape of the pile to the typically larger hammer base or drive cap assembly and to maintain axial alignment of the pile and hammer, insuring concentric transmission of the hammer blows during driving. It consists of an attachment/striker plate 21, a skirt 19 and bell shape structure 20. The attachment/striker plate 21 is either round or square in shape and of appropriate dimension to adapt to the hammer base or drive cap of the impact hammer to be used. To assist the proper alignment of the pile and driving hammer and to accommodate the strand extending beyond the top of the cushion block, a hole 22 with countersink 23 is provided. The beveled shape of the countersink facilitates the insertion of the strand in to the hole. The bell 20 and the skirt 19 aid the introduction of the pile top with exposed strand 11 and attached cushion block 12.

An internal square sleeve splice as shown in FIG. 10 is employed in those situations where the required pile lengths to be installed are in excess of the practical single piece limits imposed by manufacturing or transportation, or where site limitations due to overhead or other conditions restrict the lengths of piles that can be in installed in one piece. For these situations, a piece of hollow, preferably square steel tubing, as shown in FIG. 10, is centered on the longitudinal axis of the pile, situated with the sides of the tubing parallel to the sides of the pile, the end of the tubing nearly but, not quite flush with the end face of the pile and, with the single prestressing strand 11 passing through the full length of tubing. With the pouring of concrete into the mold, concrete is excluded from entering this embedded tube 24. In square dimension, this embedded tubing is approximately 25% of the side dimension of the pile and, having a total length of approximately 125% of the side dimension of the pile. The identical arrangement, including the exposed strand 11 extending beyond the end face of the pile, is installed in the lower end portion of what is the upper pile section.

As the single strand 11 passes through the embedded tube 24 and extends beyond the end face of the pile for the appropriate distance on both sections, they overlap when joined face to face as shown in FIG. 11. In use, as the lower section of pile is driven nearly its full length into the ground, an aligning pin 25, fabricated from a smaller square tube of outside dimension slightly less than the inside dimension of the embedded tube 24 and approximately 90% of two times the embedded tube length, is threaded over the exposed portion of strand and inserted into the embedded tube 24 of the lower section of pile. When the upper section of pile is raised, positioned over the already driven lower section with the aligning pin in place, and then lowered to make up the whole pile, the exposed strand 11 which protrudes from the lower end of the upper section is threaded into the aligning pin 25 (inner tube). The aligning pin 25 is fabricated with a diagonal cut on each end 26 and 27 and with the leading edges having bevels 28. As the upper section of pile continues to be lowered in place, the aligning pin 25 beveled end 28 aligns the embedded tubes 24 such that the sides form a continuous plane and thus the sides of the pile sections are also aligned in the same planes. The strand ends 11, which extended beyond the ends of the pile face when cast, now slide past each other inside the hollow aligning pin 25 as the upper section is lowered in place and overlap for the full length of their exposed portion plus the length inside the embedded tube, or to a distance of at least 36 times the diameters of the strand. In instances where no tension load is required to be transmitted across the splice during use, the splice is completed when the upper section is lowered to contact the upper end face of the previously driven lower section and driving with the pile hammer resumes.

In those situations where tension capacity through the splice is desired, a bonding agent such as an epoxy resin or a grout mixture of epoxy resin and filler material or other material is introduced into the embedded tube of the lower pile section and the hollow aligning pin 25 prior to placement of the upper section during the splicing operation. The two sections are otherwise made up in identical fashion. The bonding agent also provides additional mechanical strength.

The dimensions indicated for the pile, cushion block, pile-hammer adaptor, and internal square sleeve splice are shown for clarity and example only and are not intended to be indicative of any limits to size or arrangement. From an engineering perspective and as a result of technical limitations imposed by the size of the largest prestressing strand commonly available in the United States (0.60 inches in diameter), the cross sectional area of the pre-cast prestressed concrete pile is currently limited to just over 64 square inches (approximately 413 cm square). In recognition of recent advances in the technology of prestressing and prestressed strand it is anticipated that this limitation will change and larger cross sectional areas will be practical.

What is claimed is:

1. A prestressed pre-cast concrete foundation pile system, comprising:

a concrete pile having a middle portion and two end portions;

means for concentrating prestressing forces along the longitudinal center axis of the pile;

means for maintaining the pile in axial alignment with a pile hammer while allowing relative axial rotation between the pile and the pile hammer during hammering of the pile and for protecting the pile during handling and during driving; and means for adapting the pile to a pile hammer drive cap to allow hammering of the pile; and wherein the maintaining and protecting means comprises a cushion block having a central region defining a longitudinal hole with a countersink on each of two oppositely disposed ends, the cushion block being adapted for placement onto one extended portion of the strand so that the extended portion of the strand can protrude through the longitudinal hole, and further being adapted to work in engagement with a pile hammer.

2. A prestressed pre-cast concrete foundation pile system, comprising:

a concrete pile having a middle portion and two end portions;

means for concentrating prestressing forces along the longitudinal center axis of the pile;

means for maintaining the pile in axial alignment with a pile hammer while allowing relative axial rotation between the pile and the pile hammer during hammering of the pile and for protecting the pile during handling and during driving; and means for adapting the pile to a pile hammer drive cap to allow hammering of the pile;

and wherein the adapting means comprises a tubular skirt with a bell shaped structure at one end of the skirt and a striker plate at the other end of the skirt, the striker plate having an interior region defining a hole with a beveled countersink.

3. A prestressed pre-cast concrete foundation pile system, comprising:

a concrete pile having a middle portion and two end portions;

means for concentrating prestressing forces along the longitudinal center axis of the pile;

means for maintaining the pile in axial alignment with a pile hammer while allowing relative axial rotation between the pile and the pile hammer during hammering of the pile and for protecting the pile during handling and during driving; and means for adapting the pile to a pile hammer drive cap to allow hammering of the pile; and wherein the transmitting means comprises an L-shaped, deformed reinforcing bar secured by a clamp to the end of the extended portion of the strand.

4. A prestressed pre-cast concrete foundation pile system, comprising:

a concrete pile having a middle portion and two end portions;

means for concentrating prestressing forces along the longitudinal center axis of the pile;

means for maintaining the pile in axial alignment with a pile hammer while allowing relative axial rotation between the pile and the pile hammer during hammering of the pile and for protecting the pile during handling and during driving;

means for adapting the pile to a hammer drive cap to allow hammering of the pile;

means for preventing relative axial rotation between two piles joined end to end, wherein the relative axial rotation preventing means comprises a square tube embedded in an end of a first pile, a matching square tube embedded in an end of a second pile, and a hallow square aligning pin for aligning the square tube so that first and second piles can be joined to form a longer continuous pile; and means for binding together abutting exposed strands of first and second joined piles.

* * * * *